US005906277A

United States Patent [19]

Vienneau

[11] Patent Number: 5,906,277

[45] Date of Patent: May 25, 1999

[54] GEAR BAG

[76] Inventor: Gerald Vienneau, Gr.#2 Box 29, Balmoral, N.B., Canada, E0B 1C0

[21] Appl. No.: 08/985,249

[22] Filed: Dec. 4, 1997

[51] Int. Cl.[6] ..... B65D 85/18; A47F 5/00; E04H 1/12

[52] U.S. Cl. ..... 206/315.1; 206/287.1; 206/292; 211/182; 312/6

[58] Field of Search ..... 206/315.1, 286, 206/287, 287.1, 289, 292, 299; 211/85.7, 182; 312/5, 6; 280/814, 47.131

[56] References Cited

U.S. PATENT DOCUMENTS

| | | | |
|---|---|---|---|
| D. 242,011 | 10/1976 | Rabe . | |
| D. 322,598 | 12/1991 | Cassel . | |
| 1,081,848 | 12/1913 | MacDonald | 206/287 X |
| 3,348,665 | 10/1967 | Andretich | 206/315.1 |
| 3,409,141 | 11/1968 | Cunnningham, Jr. et al. . | |
| 3,532,224 | 10/1970 | Grubb et al. . | |
| 3,679,280 | 7/1972 | Friederich et al. | 312/6 |
| 4,358,137 | 11/1982 | Gramm | 280/814 |
| 4,792,071 | 12/1988 | Scapra et al. | 273/68 |
| 4,890,749 | 1/1990 | Walter | 211/182 X |
| 5,377,849 | 1/1995 | Martin . | |
| 5,390,786 | 2/1995 | Challoner et al. | 206/292 X |
| 5,779,036 | 7/1998 | Westbrook et al. | 206/292 |

FOREIGN PATENT DOCUMENTS

| | | |
|---|---|---|
| 61-163040 | 7/1986 | Japan . |
| 944698 | 12/1963 | United Kingdom . |

*Primary Examiner*—Bryon P. Gehman
*Attorney, Agent, or Firm*—McFadden, Fincham

[57] ABSTRACT

There is provided a collapsible portable container for mounting and storing sports gear in which the device includes a first fixed base, an opposed second base, a support for mounting said first and second bases in an opposed relationship, with the support being adapted to extend between a collapsed position and an extended position, and a plurality of spaced apart garment/gear hanging component extending downwardly from the second base.

18 Claims, 6 Drawing Sheets

GEAR BAG

FIELD OF THE INVENTION

This invention relates to portable storage containers, more particularly, storage containers of the type used to store sports gear in an arrangement which permits airflow through the container and gear.

BACKGROUND OF THE INVENTION

Certain types of devices for storing sports equipment have been disclosed, one example being that taught in U.S. Pat. No. 5,377,849. The arrangement disclosed includes a fixed rack of hollow tubular supports which can optionally be enclosed within an outer covering and a tubular rectangularly shaped handle provided for carrying the rack. Other arrangements include yarn package racks or trucks such as is illustrated in U.S. Pat. No. 3,409,149 in which textile material is suspended over supporting frames or racks and is transported between different stations.

The concept of storing sports gear on a rack, although known, has only evolved to the point where storage is feasible but, there are significant disadvantages with arrangements such as those disclosed in the above references. As most sports players will recognize, sports gear after use—e.g. equipment used by a player in a hockey game, has to dry between usages in order to be usable at a future date. The arrangement of the types outlined above are substantially not capable of drying worn gear; furthermore, such arrangements are relatively bulky for storage purposes when not in use.

It would be highly desirable if a sports gear storage container could be collapsed when not in use and which, at the same time, when in use, can provide aeration to permit sports articles, which may be of different sizes, to be dried.

SUMMARY OF THE INVENTION

In accordance with this invention, there is provided a portable container adapted to mount and store sports gear in a manner such that the gear may be transported, aired and dried.

According to one aspect of the invention, there is provided a frame having support means extending therefrom, the frame mounting a plurality of spaced apart individual garment/gear hanging means associated with from the frame.

In another aspect of the invention, there is provided a collapsible portable container for mounting and storing sports gear comprising a first fixed base, an opposed second base, support means for mounting said first and second bases in an opposed relationship, said support means being adapted to extend between a collapsed position and an extended position, and a plurality of spaced apart garment/gear hanging means extending downwardly from said second base.

According to a preferred embodiment of the present invention, there is provided a collapsible sports storage gear bag comprising a portable container having a pair of opposed end frame members forming opposed ends of a gear rack containable within the gear bag, at least one of said opposed end frame members having support means extending therefrom, said support means extending to the other opposed end frame member, a plurality of spaced-apart gear hanging or mounting means operatively associated with said support means, said gear hanging means being spaced between said opposed end frame members, and at least one of said opposed end frame members being collapsible to permit said bag to have a reduced volume for storage.

In other preferred embodiments of the above gear bag, the bag is preferably one wherein both of said opposed end frame members are collapsible. In a still further form, the bag includes at least two gear-mounting means between said opposed frame members, at least one of said gear mounting means being capable of rotating about said support means. In another embodiment, at least one of said gear mounting means includes a spring and is capable of folding or collapsing under pressure.

In a still further preferred form, the above bag preferably has at least one of said end frame member which includes a telescopic portion whereby said telescopic portion may be retracted and extended from a fixed portion. In a still further form, the gear bag may have fixed portions which include means for permitting said fixed portion to collapse about a fixed axis. In another preferred embodiment the gear bag includes at least one pair of spaced-apart wheel members associated with one of said frame members for permitting said bag to be pulled.

In still other embodiments, the container includes a removable cover for said gear bag. Another form of the invention is where the bag includes a handle associated with said cover for carrying said bag. In another embodiment, the frames include snap fasteners to mount said removable cover to each of said frame members. A further embodiment includes identification means attached to the gear bag.

In a still further embodiment the above gear bag has support means which comprise a pair of mounting members threadably connected to each other. In this form, the support means are removably connected at either end to said frame members. Preferably, the mounting means includes a plurality of releasable straps for temporarily mounting gear. Still further, another embodiment is where at least one of said frame members include a plurality of apertures adapted to permit circulation of air from said frame members. Preferably, the support means comprises an extendable and retractable telescopic pole.

The above gear bag may include square or circular frame members or any other suitable tubular members adapted to be used for support members and end members.

The end frame members of the above gear bag can be made of any suitable material, such as, for example, metals, plastics, etc. As will be understood, these are examples only and any other suitable materials can be utilized.

The support members of the above gear bag can be made of any suitable material such as materials similar to those utilized in the frame members.

The cover of the above gear bag can be made of any suitable material, such as, for example, cloth, nylon, polyester or the like. As will be understood, these are examples only and any other suitable materials can be utilized.

The gear mounting means and the holding means of the above gear bag can be made of any suitable rigid material such as that utilized for the frame members or support members.

Having thus generally described the invention, reference will now be made to the accompanying drawings illustrating preferred embodiments.

BRIEF DESCRIPTION OF THE DRAWINGS

Similar numerals in the drawings denote similar elements.

DETAILED DESCRIPTION OF THE DRAWINGS

Figure 1:
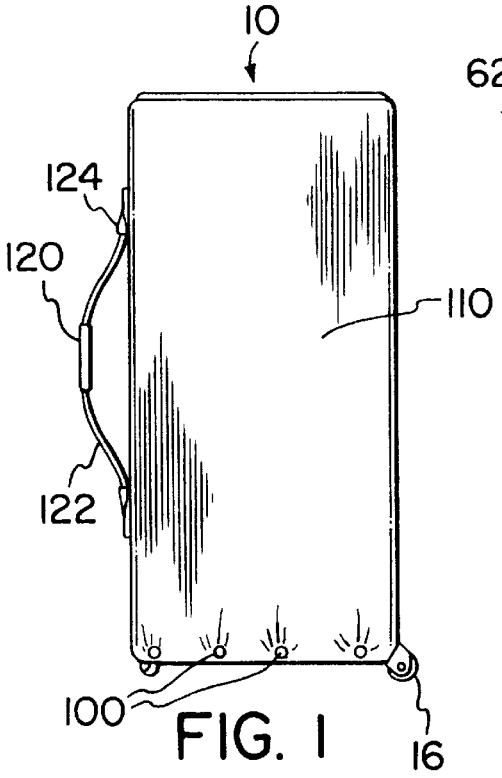
FIG. 1 is a side elevational view of the invention as it stands in a closed position

Referring to the drawings, the portable collapsible sports gear device is shown. Referring to the drawings illustrating the internal structure first, the device of the present invention is provided with a base indicated generally by reference numeral 13 which is preferably of a rigid structure having a peripheral base frame 12 and cross-supporting members 14. This base is mounted on roller means which may include two or more wheels 16 to permit the article to be readily transported by pulling if desired. Optionally, the bottom frame will contain springs 72 which will allow the frame to collapse. This will be discussed in further detail hereinafter.

Extending upwardly from the base peripheral frame 12 is a support 18 which, according to the present invention, comprises a support member 22, (which may alternatively be, e.g. a telescoping or extension support or pole), which has a threaded top end 50 and bottom end 52. Such a support member 22 is able to extend equipment higher or lower once the cover bag is removed or lowered. Other arrangements may also be employed, such as quick connect/disconnect couplings.

Mounted on support 22 and the support 18 is handle 20. Handle 20 is adapted to lock or release the extension pole or support 22. Connected to the support 22 are swivels 30, or other conventional rotating means, mounted on which are arms 40, adapted to rotate around a fixed axis on the swivel. These arms may optionally have up-turned ends to hold clothing, equipment or the like. In a further alternative embodiment, arms 40 may include means adapted to enable collapse of said arms 40 , such as e.g., swivels of springs, under pressure for safety considerations or the user and or the surrounding environment.

Figure 2:
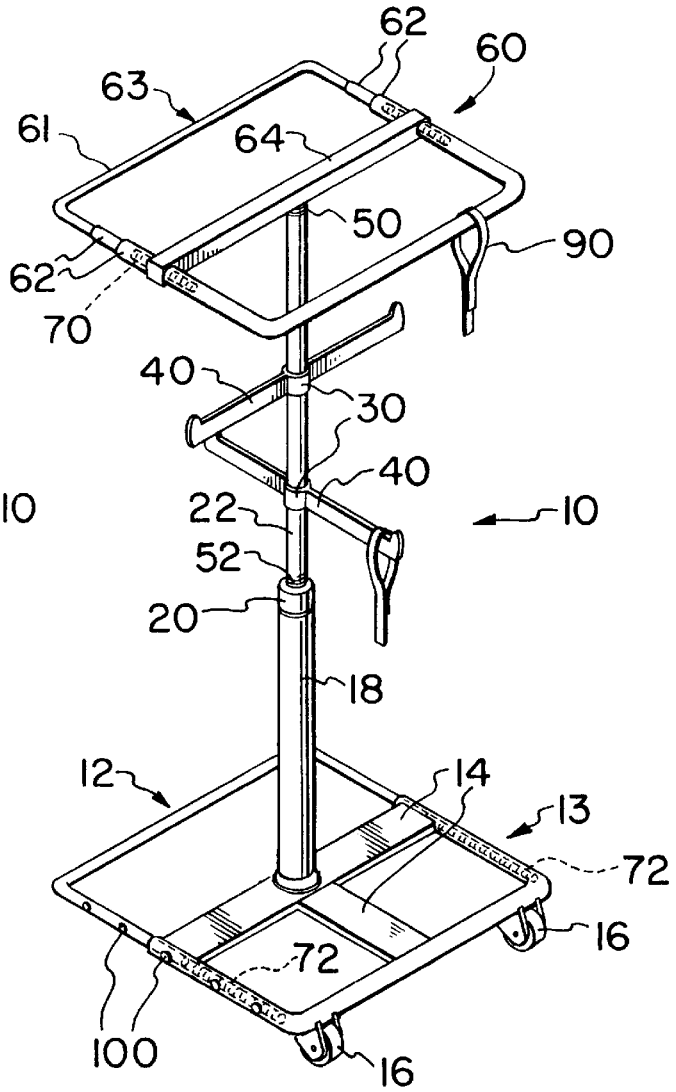
FIG. 2 is a cross sectional view of the invention according to FIG. 1, in which the device is in a fully telescoped upright position.

Mounted on top of the support 22 is a telescoping rack or frame generally referenced by numeral 60, having a peripheral frame 63 with cross supporting members 64. One side, shown in a preferred embodiment in FIG. 2, has a telescoping portion 61 adapted to be extended and retracted as desired to e.g., adapt to different sizes of equipment. Mounted in both sides of the frame 63 are springs 70 which allow the rack to collapse when desired if space is limited (e.g. during transportation in a vehicle or the like). The top frame or telescoping rack 60 includes telescopic couplings 62 to effect telescoping movement of portion 61.

In a particularly preferred embodiment, the use of Velcro straps 90 removably mounted to any of the arms or top frame members or cross structure members allow for equipment to be hung from the rack or securely attached to the rack.

In a particularly preferred embodiment, the tubing of the frame is provided with apertures (not shown) which would allow air to flow in and out of the frame, e.g. in-between the equipment or the like, to dry and or warm the equipment prior or after usage.

Optionally mounted on the frame are cover bag mounts 100 which may be e.g. snap fasteners, Velcro or other conventional fasteners adapted to mount the cover bag 110 to the frame. As shown in FIG. 1, the bag includes a handle 120, connecting straps 122 and mountings 124 of which are mounted to the cover bag and which may alternatively be any conventional means used in the art.

Figure 6:
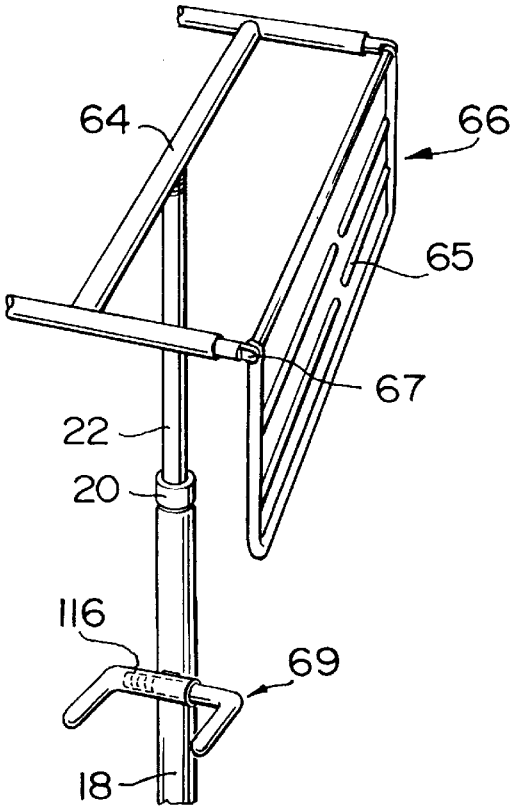
FIG. 6 is a side elevational view of an alternative embodiment of FIG. 3 in which the hinged upper rack is in a unlocked position.

In a preferred embodiment, the device includes holder means 69 such as illustrated in FIG. 6 and more specifically 6A, to hold selected equipment such as skates in case of hockey equipment in a locked together arrangement, e.g. such as in a binder which would serve to protect both the individual and the surrounding environment. In a further preferred embodiment, the holder means includes a removable binder adapted to be transportable from the device and able to convey, e.g., skates, in a protected way, e.g., locked together such as a ski binder.

In another preferred embodiment, the device includes holder means to hold selected equipment such as cleats in the case of football equipment, or roller blades in the case of roller hockey. Optionally, in the case of roller blades, a binder type of holder means would be used to hold rollerblades in a locked position on said skate holder means.

Figure 2A:
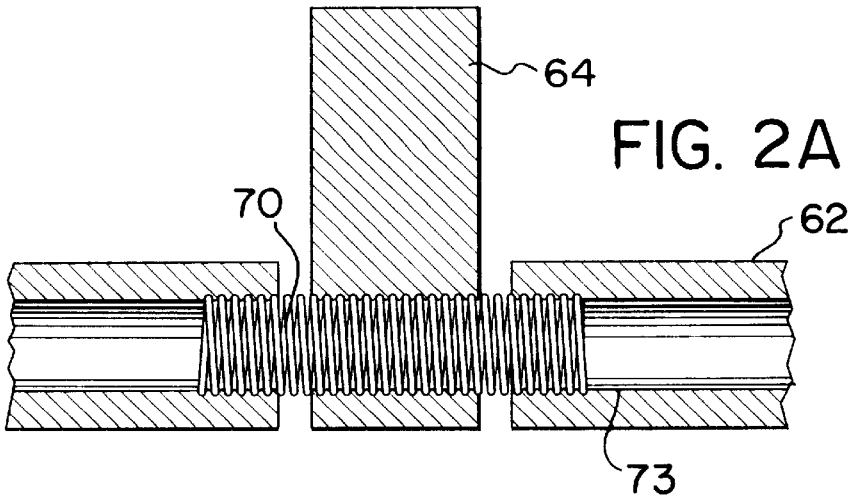
FIG. 2A is a cross sectional cut away view of the invention according to FIG. 2, in which the spring device of the upper frame is shown.

With specific reference to FIG. 2A, FIG. 2A shows the cross support bar 64 having springs 70 affixed in a peripheral tubular frame 62 by any suitable means, e.g., threaded tubing 73. In an alternative embodiment, hinge means or any other suitable means may be used in place of springs 70. In a still further alternative embodiment, peripheral base frame 12 may include springs 72 or other suitable means and secured in a similar fashion.

Figure 2B:
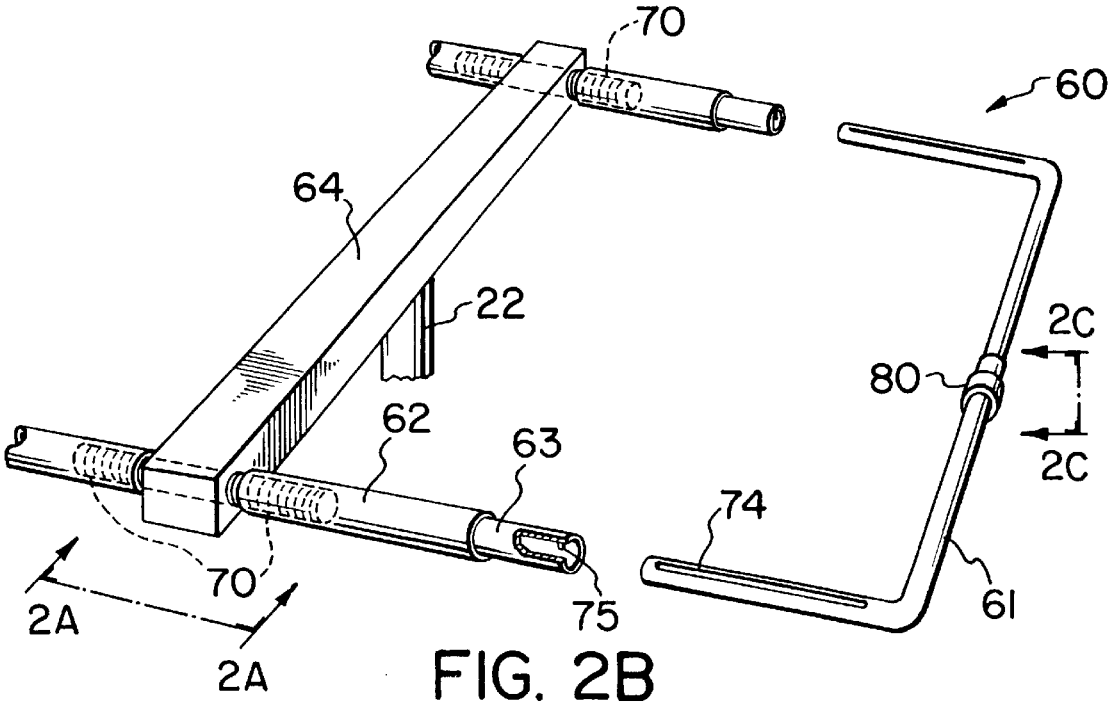
FIG. 2B is a top elevational view of the telescopic frame in one embodiment in which both sides of the rack are in an extended position.

FIG. 2B shows a cross-sectional view of telescopic rack 60 with an upper peripheral frame 63 affixed to cross support 64 mounted onto support member 22, and includes an upper telescopic partition 61 having telescoping couplings 62 with means 80 to permit opening and closing of an area on the telescoping partition 61. Peripheral frame 63 in a preferred embodiment includes pin 75 or other suitable locking means and corresponding slot 74 which is adapted to secure frame 63 in an extended position.

Figure 2C:
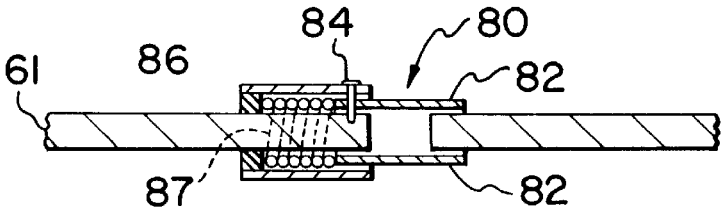
FIG. 2C is a side elevational view of the telescopic partition of the upper rack in which means to allow sliding access to the frame is controlled.

FIG. 2C shows means 80 which includes, e.g., a bolt 84 (or other suitable apparatus) for securing arms 82, which are adapted to slide by spring 87 to allow access for equipment or the like to slide onto partition 61. In an alternative embodiment, housing 86 may include cavities to receive arms 82 when in operation.

Figure 3:
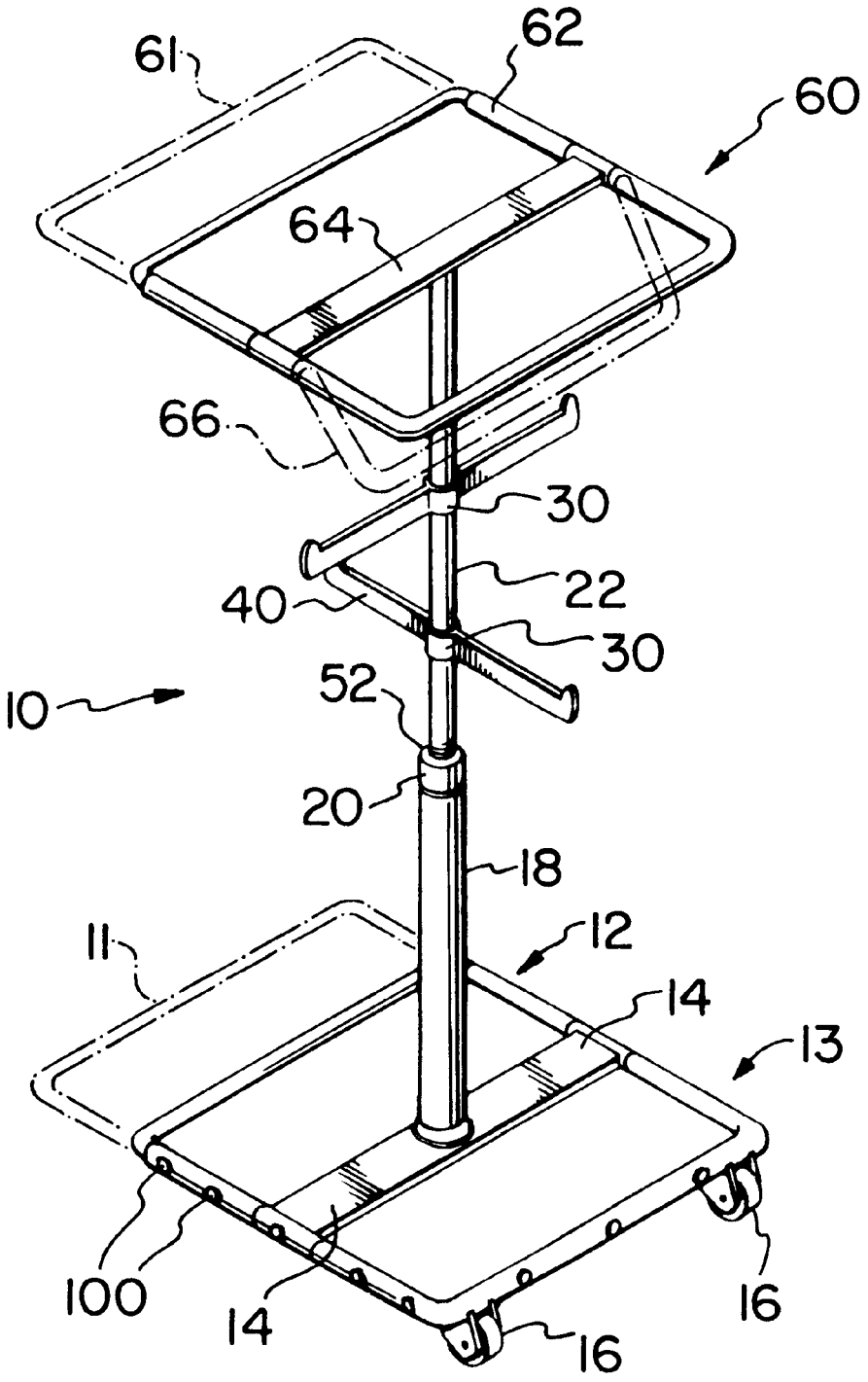
FIG. 3 is a cross section view of an alternative embodiment of FIG. 2 in which both top and bottom frames telescope.

FIG. 3 shows an alternative embodiment of the gear bag 10 in which gear bag 10 includes a peripheral base frame 12, having cover bag mounts 100, cross support members 14 and a base telescoping partition 11. In a preferred alternative embodiment, extending partition 11 comprises a smaller diameter tubing than peripheral frame 12 and is adapted to extend and retract in a similar fashion as upper rack 60. Also shown is upper rack 60 having a hinged extension rack 66, to be discussed in greater detail further on.

Figure 4:
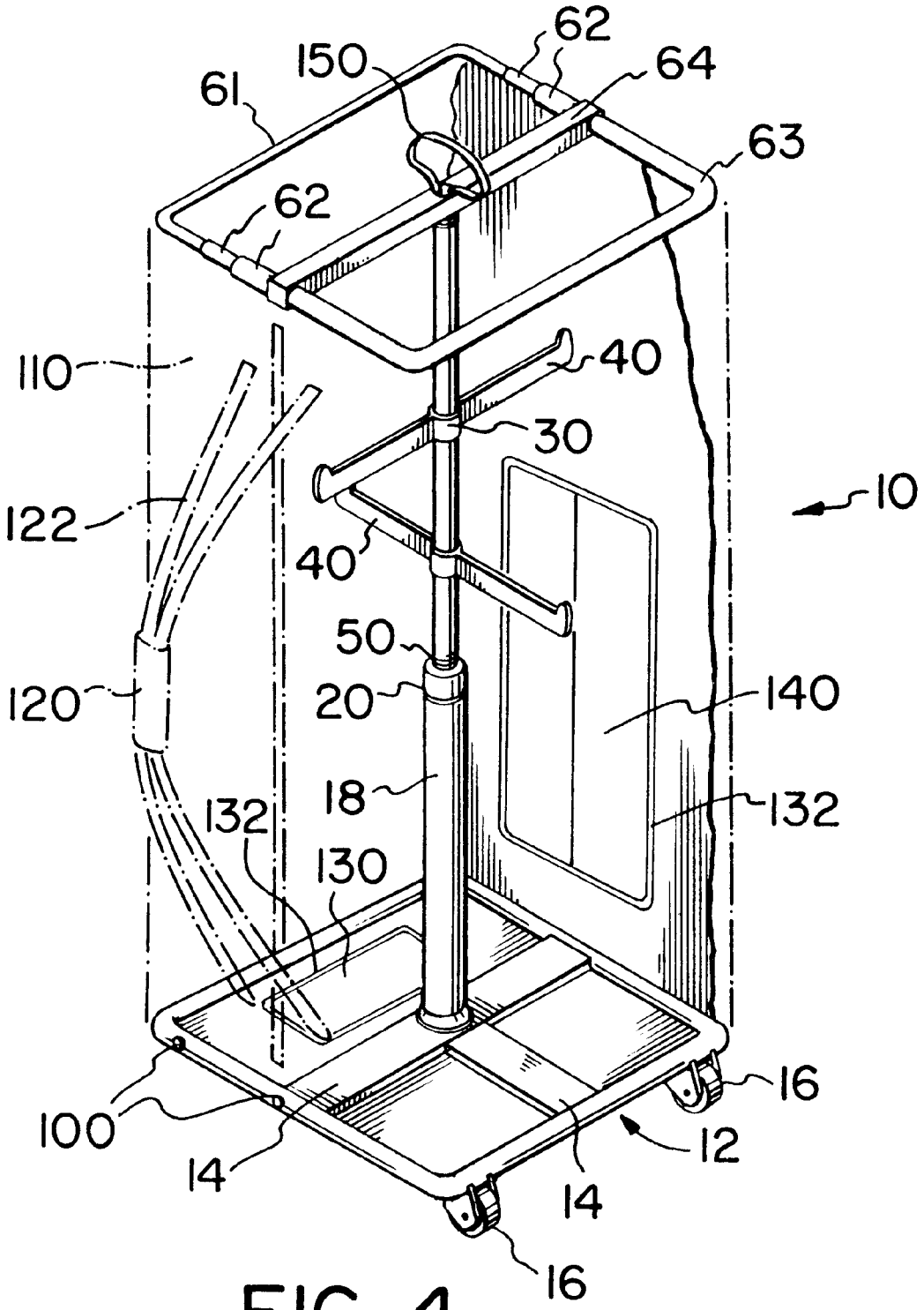
FIG. 4 is a cut away view of the present invention showing the device inside a covering ready for transportation or storage.

FIG. 4 shows an alternative embodiment 10 in a downward telescoped or recessed position enclosed in a corresponding cover bag 110. In a still further preferred embodiment, gear bag 10 as shown includes a telescoping handle 150 including gripping means (not shown), where handle 150 is adapted to permit rolling movement when used in conjunction with wheels 16.

The cover bag 110 as shown in FIG. 4, of a preferred embodiment, includes a handle 120, connecting straps 122, and includes apertures 130 and 140. Aperture 130 is, in a preferred embodiment, covered by a flap (not shown) adapted to expose a mesh type netting or the like and is adapted to allow air to travel into the interior of the bag. In a further preferred embodiment, the cover bag 110 can be positioned over a floor register or other device to have forced air vented into the interior of the bag through aperture 130 to e.g., dry or aerate equipment. Further, cover bag 110 preferably includes aperture 140 having e.g., mesh type netting or other suitable material to allow air flow through the bag. Apertures 130 and 140 include fastening means 132, e.g., Velcro backings, to secure netting, flaps or coverings which may be removed when desired.

Figure 5:
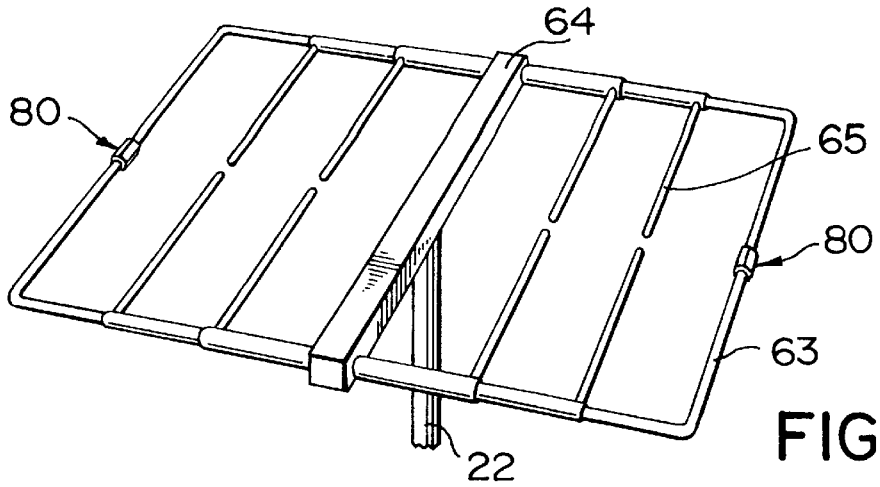
FIG. 5 is a side elevational view of an alternative embodiment in which the upper telescoping rack has a plurality of extra bars.

FIG. 5 shows an alternative embodiment in which the upper rack generally indicated by the numeral 60 includes at least one extra bar 65 positioned one each side of frame 63 and which is adapted to secure equipment or other suitable gear.

FIG. 6 shows another alternative embodiment in which the upper rack 60 includes an extension rack 66 having a hinge 67, detent means (not shown), and at least one extra bar 65 mounted on the peripheral frame 63. Also shown mounted on support means 18 is at least one skate holding means 69.

Figure 6A:
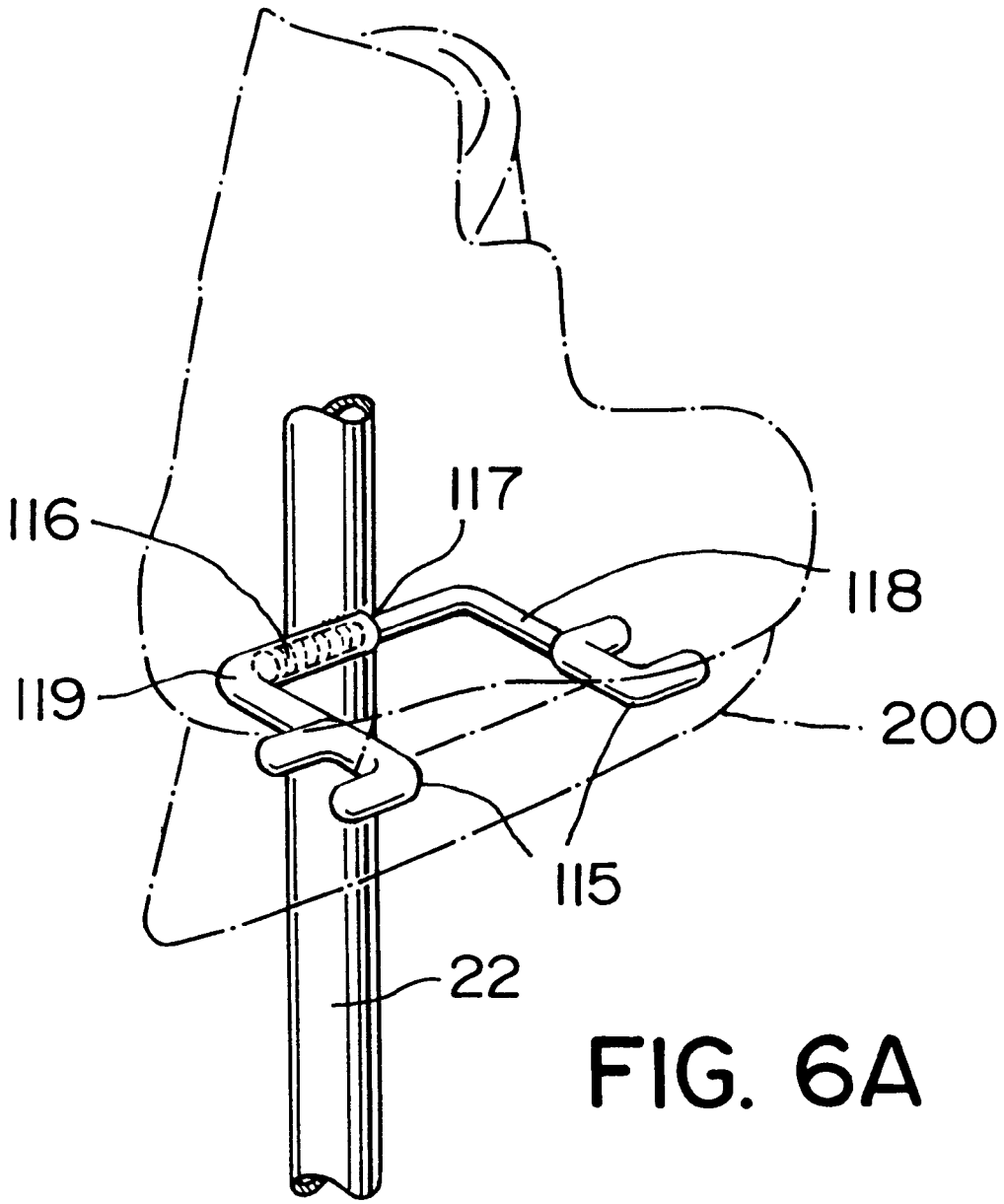
FIG. 6A is a side elevational view of an alternative embodiment of a skate holding means.

FIG. 6A illustrates an alternative embodiment of skate holder 69, which includes support mounting means 117, a spring 116 mounted to support arm 119, a retractable support arm 118, and a pair of "U-shaped" skate holding means 115 affixed to an end of each support arm. Skate 200 is shown in phantom lines.

Figure 7:
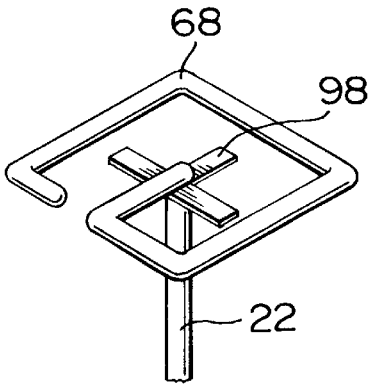
FIG. 7 is a side elevational view of an alternative embodiment in which a fixed upper rack is shown to be used in combination with a bottom frame member of the present invention.

FIG. 7 shows a still further embodiment, used in operation with a bottom frame member (not shown) wherein the upper rack 68 is of a fixed configuration mounted onto supports-98, adapted to mount and store equipment, e.g., hockey gear or the like.

Although embodiments of the invention have been described above, it is not limited thereto and it will be apparent to those skilled in the art that numerous modifications form part of the present invention insofar as they do not depart from the spirit, nature and scope of the claimed and described invention. Thus, various forms of the gear bag can be adapted for different sports and the equipment of such other sports—for example, field hockey, street hockey, ringette, lacrosse, motocross and other sports requiring similar equipment able to be stored.

I claim:

1. A collapsible sports storage gear bag having an enclosed gear rack, said rack having a pair of opposed end frame members forming opposed ends of said gear rack and defining end frame supports for said bag, at least one of said opposed end frame members comprising a base end having a collapsible main support means extending therefrom adapted to support gear mounting means, said main support means being extendable to the other opposed end frame member; a plurality of spaced-apart gear mounting means operatively associated with said main support means, said gear mounting means being spaced between said opposed end frame members; and at least one of said opposed end frame members being collapsible to permit said bag to have a reduced volume for storage.

2. The gear bag of claim 1, wherein both of said opposed end frame members are collapsible.

3. The gear bag of claim 1, wherein there are included two gear mounting means mounted on said gear rack and positioned between said opposed frame members, one of said gear mounting means being rotatable about said support means.

4. The gear bag of claim 1, wherein said support means is removably connected at either end to said frame members.

5. The gear bag of claim 1, wherein said mounting means includes a plurality of releasable straps for temporarily mounting gear to said support means.

6. The gear bag of claim 1, wherein said support means comprises an extendable and retractable telescopic pole.

7. The support means of claim 6, wherein at least one of the support means includes a telescoping handle.

8. The gear bag of claim 1, wherein said mounting means includes skate holding means.

9. The gear bag of claim 1, wherein one of said end frame members comprises a fixed top member.

10. The gear bag of claim 9, wherein one of said frame members is an upper frame member, and wherein said upper frame member includes coupling means adapted to telescopically receive a further telescopic section.

11. The gear bag of claim 10, wherein said end frame includes support means, said support means mounting a housing, spring means joining said support member and housing whereby said spring means permits said housing to be collapsed.

12. The gear bag of claim 11, wherein at least one of the opposed frame members includes a tubing member adapted to receive said spring means.

13. The gear bag of claim 1, wherein at least one of said opposed frame members includes a locking means having a pin, and a corresponding slot adapted to lock said pin in an extended position.

14. The gear bag of claim 1, wherein said mounting means includes skate retaining means.

15. A collapsible sports storage gear bag having an enclosed gear rack, said rack having a pair of opposed end frame members forming opposed ends of said gear rack and defining end frame supports for said bag;

at least one of said opposed end frame members comprising a base end having a main collapsible main support means extending therefrom, adapted to support gear mounting means, said main support means being extendable to the other opposed end frame member;

a plurality of spaced-apart gear mounting means operatively associated with said main support means, said gear mounting means being spaced between said opposed end frame members; and at least one of said opposed end frame members being telescopically collapsible to permit said bag to have a reduced volume for storage.

16. The gear bag of claim 15, wherein said fixed portion includes means for permitting said fixed portion to collapse about a fixed axis.

17. The gear bag of claim 15 wherein said frame members include snap fasteners adapted to mount said cover to each of said frame members.

18. The gear bag of claim 15, wherein at least one of said frame members include a plurality of apertures adapted to permit circulation of air therethrough.

* * * * *